US005759673A

United States Patent [19]

Ikezawa et al.

[11] Patent Number: 5,759,673

[45] Date of Patent: Jun. 2, 1998

[54] INK JET RECORDING SHEET

[75] Inventors: Hideo Ikezawa, Tokyo; Tomotsugu Miyoshi, Kawagoe; Yoshiharu Kawashima, Solta; Izumi Tashiro, Ichikawa, all of Japan

[73] Assignee: New OJI Paper Co., Ltd. Tokyo, Japan

[21] Appl. No.: 661,476

[22] Filed: Jun. 11, 1996

Related U.S. Application Data

[63] Continuation-in-part of Ser. No. 365,426, Dec. 28, 1994, abandoned.

[30] Foreign Application Priority Data

Dec. 28, 1993 [JP] Japan ..... 5-349174
Apr. 27, 1994 [JP] Japan ..... 6-110220

[51] Int. Cl.[6] ..... B41M 5/00; B41J 2/01

[52] U.S. Cl. ..... 428/198; 347/105; 428/195; 428/317.3; 428/331; 442/221; 442/370

[58] Field of Search ..... 428/304.4, 308.4, 428/195, 198, 317.3, 331; 442/221, 370; 347/105

[56] References Cited

U.S. PATENT DOCUMENTS

| | | |
|---|---|---|
| 4,702,742 | 10/1987 | Iwata et al. . |
| 4,786,288 | 11/1988 | Handa et al. . |
| 4,902,568 | 2/1990 | Morohoshi . |
| 5,001,106 | 3/1991 | Egashira et al. . |
| 5,312,671 | 5/1994 | Atherton et al. . |

FOREIGN PATENT DOCUMENTS

| | | |
|---|---|---|
| 0 379 964 | 8/1990 | European Pat. Off. . |
| 58-136478 | 8/1983 | Japan . |
| 62-158084 | 7/1987 | Japan . |
| 64-36478 | 2/1989 | Japan . |
| 3-140284 | 6/1991 | Japan . |

OTHER PUBLICATIONS

Derwent Publications—93–014894 & JP–A–4 344 284; OJI Paper Co.—30 Nov. 1992—Abstract—Section Ch, Week 9302.

Derwent Publications—94–337872 & JP–A–6 262 712; OJI Paper Co.—20 Sep. 1994—Abstract—Section Ch, Week 9442.

*Primary Examiner*—Pamela R. Schwartz
*Attorney, Agent, or Firm*—Armstrong, Westerman Hattori, McLeland & Naughton

[57] ABSTRACT

An ink jet recording sheet, having high ink absorption, water resistance, persistency, a satisfactory fabric-like soft touch, mechanical strength and being capable of recording ink images having a high quality, includes a foamed undercoat layer formed on a surface of a substrate sheet and comprising a polymeric binder and an ink-receiving layer formed on the foamed undercoat layer from a mixture of 50 to 90% by weight of an amorphous silica having an oil absorption value of 100 to 400 ml/100 g with 10 to 50% by weight of a polymeric binder, and provided with a surface thereof having a Bekk smoothness of 10 seconds or less determined by JIS P 8119.

21 Claims, No Drawings

INK JET RECORDING SHEET

CROSS REFERENCE TO RELATED APPLICATION

This application is a continuation-in-part application of Ser. No. 08/365,426 filed on Dec. 28, 1994, now abandoned.

BACKGROUND OF THE INVENTION

1. Field of the Invention

The present invention relates to an ink jet recording sheet. More particularly, the present invention relates to an ink jet recording sheet having high ink absorption, water resistance and mechanical strength, a satisfactory soft touch and persistency, a capability of recording clear ink images thereon and suitable for use for hand-writing to the same extent as fine paper sheets or coated paper sheets.

2. Description of Related Art

In the field of ink jet recording systems, particularly aqueous ink jet recording systems, the printing performances, for example, printing speed, resolving power and chroma are currently significantly developing. Due to the development of the recording systems, the field of use of ink jet recording systems is expanding. However, with respect to the recording material, further enhanced performance is required. Especially, a coated recording sheet having an ink-receiving layer formed on a substrate sheet is developed for the purpose of improving the ink absorption speed and controlling the amount and regulated of the ink.

For example, Japanese Unexamined Patent Publication (Kokai) No. 62-158084 discloses a process for producing an aqueous ink jet recording sheet having an ink-receiving layer comprising fine synthetic silica particles dispersed on a binder resin matrix, and thus exhibiting an enhanced ink absorption, an improved color-reproduction property and a high color density. Namely, it is known that a resinous coating layer comprising a white pigment, for example, fine synthetic silica particles having a high ink absorption, is formed on a surface of a substrate sheet comprising, as a principal component, a cellulose pulp.

Also, due to the expansion of the field in which ink jet recording systems are used, ink jet-recording systems have become widely used in office documentation and for advertisements, especially, purchase-offering advertisements, due to the advantage that in the ink jet recording, no printing plate is necessary and thus a small number of printed sheets can be easily produced, and the recording or printing cost is low.

Nevertheless, the conventional ink jet recording sheet is disadvantageous in that since the substrate sheet consists of a natural pulp paper sheet, the resultant recording sheet exhibits a poor water resistance and a poor wet mechanical strength. Even if a water-resistant substrate sheet is used, the resultant conventional recording sheets have problems of expansion, wrinkling and curling when wetted with water, and thus are not suitable for outdoor use. As an attempt to eliminate the above-mentioned disadvantages, Japanese Unexamined Patent Publication (Kokai) No. 64-36478 discloses an ink jet recording sheet comprising a substrate sheet consisting of a film comprising, as a principal component, a polyolefin resin, and a hydrophobic ink-receiving-fixing layer formed on the film. This ink jet recording sheet has an enhanced water resistance, and is usable for point of purchase (POP) advertisements. However, when the polyolefin resin film is utilized, the resultant substrate sheet has no ink absorption, and thus to restrict the spreading of the ink on the surface of the recording sheet and to impart a proper ink absorption to the recording sheet, it is necessary that the ink-receiving layer is formed in a large thickness thereof. Also, this type of ink jet recording sheet is disadvantageous in that the opaqueness and flexibility thereof are unsatisfactory.

Currently, various types of nonwoven fabrics have been developed and become useful in various fields. A nonwoven fabric is prepared by accumulating a plurality of fibers (staple fibers or filaments (continuous filaments)) to form a web and subjecting the web to a process in which the fibers or filaments are partially bonded with each other or intertwined with each other. The intertwining can be effected by a wet method or a dry method. The filaments can be converted to a nonwoven fabric by a spun-bonding method, or a melt-blowing method. The properties of the nonwoven fabric are variable depending on the type of production methods thereof. Generally, the nonwoven fabric has relatively high tear strength, burst strength and tensile strength, a high water resistance and a preferred hand feeling and flexibility.

To solve the problems of the conventional ink jet recording sheets such that the water resistance, opaqueness and flexibility thereof are unsatisfactory, attempts have been made to utilize the above-mentioned non-woven fabrics, or woven fabrics, as a substrate sheet.

However, the utilization of the nonwoven fabric is disadvantageous in that when a coating liquid for the ink-receiving layer is applied to the nonwoven fabric which is porous and allows the coating liquid to easily penetrate into the nonwoven fabric, the nonwoven fabric is entirely impregnated with the coating liquid, and thus it is difficult to form a smooth ink-receiving surface. Also, the nonwoven fabric causes the coating liquid to be consumed in an excessively large amount and the resultant ink jet recording sheet exhibits an unsatisfactory stiffness and opaqueness.

An object of the present invention is to provide an ink jet recording sheet having not only high tensile strength, tear strength, water resistance and persistency and a satisfactory flexibility and hand feeling, but also an excellent ink absorption and ink-dotted image reproducibility.

Another object of the present invention is to provide an ink jet recording sheet useful for recording clear ink images thereon by using an ink jet recording printer or a plotter at high speed.

SUMMARY OF THE INVENTION

The above-mentioned objects can be realized by the ink jet recording sheet of the present invention which comprises a substrate sheet; a foamed undercoat layer formed on the substrate sheet and comprising a polymeric binder; and an ink-receiving layer formed on the foamed undercoat layer and comprising a mixture of 50 to 90% by weight of an amorphous silica having an oil absorption value of 100 to 400 ml/100 g with 10 to 50% by weight of a polymeric binder, the ink-receiving layer being provided with a surface thereof having a Bekk smoothness of 10 seconds or less, determined in accordance with Japanese Industrial Standard P 8119. This ink-receiving layer is a non-foamed non-surface smoothed resinous layer containing fine specific amorphous silica particles.

DESCRIPTION OF THE PREFERRED EMBODIMENTS

In the ink jet recording sheet of the present invention, it is important that the ink-receiving layer is located on a foamed undercoat layer, and is non-foamed and non-surface smoothed.

The foamed undercoat layer is formed on a substrate sheet by coating a substrate sheet surface with a foamed polymeric binder-coating liquid. Although this foamed polymeric binder-coating liquid has a relatively high viscosity, it can be smoothly coated on the substrate sheet surface without excessively penetrating into the substrate sheet, and forms a barrier to a coating liquid for the ink-receiving layer. When the foamed undercoat layer is solidified on the substrate sheet, the resultant layer serves as a barrier to prevent the penetration of a coating liquid for the ink-receiving layer into the substrate sheet.

The substrate sheet usable for the present invention is selected from nonwoven fabrics and woven fabrics.

The nonwoven fabrics may be produced by conventional nonwoven fabric-forming methods, for example, a spun-bonding method, wet laid nonwoven fabric-forming methods, staple fiber-carding method, hydroentanglement method, and air laying method.

Preferably, the substrate sheet for the ink jet recording sheet of the present invention is a spun-bonded filament sheet produced by accumulating spun continuous filaments to form a web and partially fuse-bonding the filaments of the web to each other. The partial fuse-bonding is carried out by heat-pressing the filament web between a pair of heat-pressing rolls having roughened surfaces, or between a surface-roughened roll and a smooth surface roll, so that the filaments are brought into contact with protruding parts of the surface-roughened roll and partly fuse-bonded to each other. Alternatively, the web is introduced between a surface-roughened roll and an ultrasonic horn and an ultrasonic treatment is applied to the web. In this ultrasonic treatment, the portions of the filaments brought into contact with the protruding parts of the roll are partially fuse-bonded to each other.

In the spun-bonded nonwoven fabric, the fuse-bonded portions serve to enhance the mechanical strength and dimensional stability of the nonwoven fabric, and the non-fuse-bonded portions impart an appropriate flexibility and hand feeling to the nonwoven fabric.

The continuous filament comprises a member selected from, for example, polyethylene, polypropylene, polyester, polyacrylate and polyamide homopolymer and copolymer resins.

The above-mentioned synthetic filaments may be employed alone or in a blend of two or more different types of filaments.

The substrate sheet usable for the present invention may be produced by a staple fiber-carding method in which staple fibers are opened and accumulated into the form of a web by a carding machine, and the staple fibers in the web are partially bonded to each other by heat-fusing or through a binder resin or binder fibers. The staple fibers are preferably selected from polyolefin fibers, polyester fibers, polyamide fibers, rayon fibers and cotton fibers. These fibers may be employed alone or in a blend of two or more types of the fibers.

The staple fibers preferably have a length of 20 to 200 mm, more preferably 30 to 150 mm. If the fiber length is less than 20 mm, the resultant nonwoven fabric produced by the staple fiber-carding method may have unsatisfactory mechanical strength and flexibility. Also, if the fiber length is more than 200 mm, it may become difficult to open the staple fibers using a carding machine, and the resultant nonwoven fabric may have a poor quality.

The nonwoven fabric usable for the present invention may be produced by a wet laid nonwoven fabric-forming method in which a plurality of staple fibers dispersed in an aqueous liquid are formed into a sheet.

The nonwoven fabric usable for the present invention may be produced by a hydro-entanglement method in which the staple fiber web prepared by the carding machine is subjected to a high pressure water jet treatment. In this treatment, the staple fibers are intertwined by action of a plurality of high pressure water jets. In this type of nonwoven fabric, the staple fibers can be selected from the above-mentioned staple fibers.

The substrate sheet usable for the present invention optionally has a multi-layered structure in which a plurality of fiber or filament sheets are laminated onto each other.

For example, a staple fiber web and a continuous filament web are laminated on each other, and a high pressure water jet treatment is applied to the laminate so that the staple fibers and the filaments are intertwined with each other to produce a spun lace nonwoven fabric.

In the ink jet recording sheet of the present invention, the substrate sheet may comprise a woven fabric having a basis weight of 20 to 150 g/m$^2$. The woven fabric may comprise at least one type of fibers or filaments of cotton, rayon, polyester, polyamide, and polyacrylic polymers.

Preferably, the substrate sheet has a thickness of 400 μm or less. If the thickness is more than 400 μm the resultant recording sheet may exhibit too poor a flexibility and thus cannot travel smoothly through a printer.

Where substrate sheet consists of a nonwoven fabric, it also preferably has a basis weight of 20 to 150 g/m$^2$, more preferably 30 to 100 g/m$^2$. If the basis weight is less than 20 g/m$^2$, the resultant substrate sheet may exhibit an unsatisfactory opaqueness and a poor handling property. Also, if the basis weight is more than 150 g/m$^2$, the resultant substrate sheet may have too low a flexibility.

Also, the continuous filaments for the spun-bonded filament nonwoven fabric preferably have a thickness of 10/9 to 100/9 dtex (1 to 10 denier), more preferably 10/9 to 70/9 dtex (1 to 7 denier). If the thickness is less than 10/9 dtex (1 denier), it may become difficult to produce a filament sheet with a satisfactory stability in the sheet-forming procedure. Also, if the thickness is more than 100/9 dtex (10 denier) the resultant filament sheet may exhibit too low a flexibility due to the thickness of the filaments.

In the production of the ink jet-recording sheet, a surface of the substrate sheet is coated with a foamed coating liquid for the foamed undercoat layer and then with a coating liquid for the ink-receiving layer.

The foamed undercoat layer-coating liquid comprises a foamed polymeric binder alone or a mixture of a foamed polymeric binder with a pigment, usually a white pigment. When the pigment is used, the mixing ratio of the weight of the pigment to the weight of the polymeric binder is preferably 95 or less:5 or more, more preferably 40:60 to 90:10. If the content of the polymeric binder is less than 5% by weight, the bonding strength between the substrate sheet and the foamed undercoat layer may be unsatisfactory.

The polymeric binder for the foamed undercoat layer comprises at least one member selected from conventional polymeric binders, for example, homopolymers and copolymers of acrylic acid esters and methacrylic acid esters, ethylene-vinyl acetate copolymers, styrene-butadiene copolymers (SBR), acrylonitrile-butadiene copolymers (NBR), methyl methacrylate-butadiene copolymers (MBR), polyester resins and polyurethane resins. These polymeric binders are used in the state of a latex or aqueous emulsion.

The above-mentioned resins may be mixed with at least one water-soluble polymer, for example, starch, esterified starches, etherified starches, polyvinyl alcohol (PVA), casein, and carboxymethyl cellulose (CMC).

The pigments, especially white pigments usable for the foamed undercoat layer are selected from inorganic pigments, for example, calcium carbonate, magnesium carbonate, magnesium hydroxide, aluminium hydroxide, zinc hydroxide, zinc oxide, titanium dioxide, aluminium oxide, silicon dioxide, amorphous silica, barium sulfate, kaolinite and talc; and organic pigments, for example, styrene polymer and copolymer resins and acrylic acid ester polymer and copolymer resins. The most preferable pigment consists of fine amorphous silica particles.

The foamed undercoat layer optionally contains an additive comprising at least one member selected from lubricants, antioxidants, ultraviolet ray-absorbing agents, colored pigments, antistatics and thickeners.

The foamed undercoat layer can be formed by foaming a coating liquid comprising a polymeric binder or a mixture of a polymeric binder with a pigment by using a conventional foaming apparatus, for example, continuous foaming machine, shaking mixer or cake mixer, made by, for example, Gaston County Co., U.S.A. or Stoke Co., Netherlands, and coating the foamed coating liquid on a surface of the substrate sheet.

The foaming operation is carried out preferably to such an extent that the volume of the coating liquid increases to 2 to 20 times that of the non-foamed coating liquid. If the foaming degree is too low, the resultant foamed coating liquid has a low viscosity and thus easily penetrates into the substrate sheet. Also, if the foaming degree is too high, the resultant foam has too large a size and thus the resultant undercoat layer has an unsatisfactory mechanical strength.

The foamed coating liquid preferably has a viscosity of 4,000 to 300,000 cps, more preferably 8,000 to 100,000 cps, measured by a Brookfield viscometer.

If the viscosity is less than 4,000 cps, even when the degree of foaming is appropriate, the resultant foamed coating liquid may undesirably penetrate into the substrate sheet and permeate to the opposite surface of the substrate sheet. If the viscosity is more than 300,000 cps, it becomes difficult to smoothly coat the foamed coating liquid.

Optionally, the coating liquid for the foamed undercoat layer contains a foam stabilizer comprising at least one member selected from higher fatty acids, modified higher fatty acids and alkali metal salts of higher fatty acids. The foam stabilizer is preferably contained in an amount of 30 parts by weight or less, more preferably 1 to 10 parts by weight, per 100 parts by weight of the solid content of the coating liquid. If the foam stabilizer is used in an amount of more than 30 parts by weight, the resultant coating liquid may exhibit an unsatisfactory storage stability.

The coating operation for the foamed undercoat layer can be carried out by using a conventional coating system, for example, a meyer bar, air knife, blade, slit die, lip, comma, roll, gravure, and rotary screen coating systems.

The foamed undercoat layer is preferably formed at a dry solid weight of 3 to 50 g/m$^2$, more preferably 4 to 30 g/m$^2$. If the dry solid weight is less than 3 g/m$^2$, the resultant undercoat layer may not serve as a satisfactory barrier layer for a coating liquid for the ink-receiving layer, and thus the ink-receiving layer-coating liquid penetrates into the substrate sheet therethrough. Also, if the dry solid weight is more than 50 g/m$^2$, the resultant ink jet recording sheet may exhibit too low a flexibility. After the foamed coating liquid is applied, the resultant coating liquid layer on the substrate sheet is dried to form a foamed undercoat layer.

Then, the surface of the foamed undercoat layer is coated by a non-foamed ink-receiving layer comprising an ink-receiving polymeric binder and a specific amorphous silica, to provide an ink-receiving layer.

In the ink-receiving layer, the amorphous silica exhibits an oil absorption value of 100 to 400 ml/100 g, preferably 150 to 350 ml/100 g, and preferably has a specific surface area of 100 to 450 m$^2$/g, more preferably 150 to 350 m$^2$/g and a secondary particle size of 1 to 10 μm.

In accordance with Japanese Industrial Standard (JIS) K 5101, an oil absorption value of an example is defined as follows.

$$G=(H/S)\times 100$$

wherein G represents an oil absorption value of a sample, H represents an amount (ml) of linseed oil required for making the sample plasticizable and S represents a weight(g) of the sample. The oil absorption value of the amorphous silica usable for the present invention can be determined in the same-mentioned manner.

The specific surface area of the amorphous silica can be determined by measuring a low temperature nitrogen absorption of the amorphous silica by using a nitrogen absorption apparatus, and calculating the specific surface area from the measured data in accordance with the Brunauer-Emmett-Teller (BET) equation. The secondary particle size of the amorphous silica can be determined by measuring a variation of electric resistance of fine amorphous silica particles in a suspended state in water.

The above-mentioned specific amorphous silica exhibits a high ink absorption and enables the printed ink images on the ink-receiving layer to be clear and to exhibit a brilliant color.

In the ink-receiving layer, the content of the amorphous silica is 50 to 90%, preferably 60 to 90% by weight, based on the total dry solid weight of the ink-receiving layer. If the amorphous silica content is less than 50% by weight, the resultant ink-receiving layer may exhibit unsatisfactory ink absorption. Also, if the amorphous silica content is more than 90% by weight, the resultant ink-receiving layer may have unsatisfactory mechanical strength.

The polymeric binder for the ink-receiving layer comprises at least one member selected from water-soluble polymeric materials, for example, polyvinyl alcohol, silanol-modified polyvinyl alcohols, esterified polyvinyl alcohols, etherified polyvinyl alcohols and acetalized polyvinyl alcohols, proteins, for example, casein, starch, esterified starches and etherified starches, cross-linked starches; water-insoluble polymeric materials in the form of a latex or aqueous emulsion, for example, conjugated diene polymers, for example, styrene-butadiene copolymers, and methyl methacrylate-butadiene copolymers, homopolymers and copolymers of acrylic acid esters and methacrylic acid esters, homopolymers and copolymers of vinyl compounds, for example, ethylene-vinyl acetate copolymers, and carboxyl or cationic group-modified compounds of the above-mentioned polymers and copolymers; and thermosetting resins, for example, melamine-formaldehyde resins and urea-formaldehyde resins, which are available as aqueous adhesive, anhydrous maletic acid copolymer resins, polyacrylamide adhesives, polymethylmethacrylate adhesives, polyurethane adhesives, unsaturated polyester adhesives, polyvinylbutyral adhesives and alkyd resin adhesives. These polymeric binder materials have a satisfactory binding property for the amorphous silica and other pigment and a high affinity to aqueous ink and thus exhibit good ink absorption.

In the ink-receiving layer, the dry solid content of the polymeric binder is 10 to 50% by weight, preferably 10 to 40% by weight, based on the total dry solid weight of the ink-receiving layer. If this content is less than 10% by weight, the resultant ink-receiving layer sometimes exhibits unsatisfactory mechanical strength. When the content is more than 50%, the amorphous silica particles are satisfactorily bonded and the resultant ink-receiving layer is firmly bonded to the undercoat layer but the resultant ink-receiving layer sometimes exhibits poor ink absorption due to the reduced content of the amorphous silica.

The ink-receiving layer can be formed by the same coating method as those of the foamed undercoat layer except that the amorphous silica-polymeric binder mixture is not foamed. The amount of the ink-receiving layer is varied depending on the use of the recording sheet and required ink absorption, recording performance, storage durability and opaqueness. Preferably, the ink-receiving layer is formed with a dry solid weight of 3 to 30 g/m$^2$. If the dry solid weight is less than 3 g/m$^2$, the resultant ink-receiving layer may exhibit an unsatisfactory ink absorption, thus the printed ink is undesirably spread, the color is spread out and the printed ink images become unclear. Also, the non-absorbed portion of the printed ink does not dry quickly and stains the guide rolls in a printer. However, if the dry solid weight is more than 30 g/m$^2$, sometimes the resultant thick ink-receiving layer cannot be firmly bonded to the undercoat layer, which can cause an ink jet nozzle in a printer to be blocked by dust generated from the ink-receiving layer, and has a high cost.

In the ink jet recording sheet of the present invention, no surface-smoothing treatment is applied to the ink-receiving layer surface. Namely, the Bekk smoothness of the ink-receiving layer is 10 seconds or less including zero, preferably 2 to 8 seconds, determined by a Bekk smoothness tester in accordance with Japanese Industrial Standard P 8119. If a surface-smoothing treatment, for example, a super calender or machine calender treatment, is applied, the resultant ink jet recording sheet exhibits an increased density. This increased density causes the resultant ink-receiving layer to exhibit a reduced ink absorption and thus an inferior dot reproducibility.

EXAMPLES

The present invention will be further explained by the following specific examples which are merely representative and do not limit the scope of the present invention in any way.

Example 1

A spun-bonded filament nonwoven fabric was prepared by melt-spinning a polyethylene terephthalate resin at a temperature of 280° C., accumulating the melt-spun filaments to form a web, and partially bonding the filaments by heat-pressing the web between a pair of embossing rolls at a temperature of 230° C. The filaments in the resultant nonwoven fabric had a thickness of 3.3 dtex (3.0 denier) and the nonwoven fabric had a basis weight of 50 g/m$^2$.

Separately, a coating liquid (1) for a foamed undercoat layer was prepared by mixing 100 parts by weight of a polyurethane emulsion (trademark: Polyurethane HW 940, made by Dainihon Ink, dry solid content: 50% by weight) with 5 parts by weight of a foam stabilizer (trademark: F-1, made by Dainihon Ink) and foaming the mixture by a hand mixer to such an extent that the apparent volume of the foamed coating liquid increased to 6 times the non-foamed coating liquid volume.

The foamed coating liquid (1) had a viscosity of 30,000 cps as measured by a Brookfield viscometer.

The foamed coating liquid (1) was coated on a surface of the nonwoven fabric by using a Meyer bar coater and dried. The resultant foamed undercoat layer had a dry solid weight of 13 g/m$^2$.

Separately, a coating liquid (2) for an ink-receiving layer was prepared by mixing 100 parts by dry weight of fine silica particles (trademark: Fineseal, made by Tokuyama) having an oil absorption value of 280 ml/100 g, a specific surface area of 290 m$^2$/g and a secondary particle size of 4.3 μm, with 30 parts by dry weight of polyvinyl alcohol (trademark: PVA 117, made by Kuraray).

The coating liquid (2) was coated on the foamed undercoat layer surface by using a Meyer bar coater and dried to form a non-foamed ink-receiving layer having a dry solid weight of 10 g/m$^2$.

An ink jet recording sheet was obtained.

Example 2

An ink jet recording sheet was produced using the same procedures as in Example 1 with the following exceptions.

A spun-bonded filament nonwoven fabric was prepared by melt-spinning a polyethylene terephthalate resin at a temperature of 280° C., accumulating the melt-spun filaments to form a web, and partially bonding the filaments by heat-pressing the web between a pair of embossing rolls at a temperature of 230° C. The filaments in the resultant nonwoven fabric had a thickness of 2.78 dtex (2.5 denier) and the nonwoven fabric had a basis weight of 100 g/m$^2$.

Separately, a coating liquid (3) for a foamed undercoat layer was prepared by mixing 100 parts by weight of a polyacrylic resin emulsion (trademark: AE513A, made by Nihon Goseigomu, dry solid content: 44% by weight) with 7 parts by weight of a foam stabilizer (trademark: SN Foam 200, made by San Nopco) and foaming the mixture by a hand mixer to such an extent that the apparent volume of the foamed coating liquid increased to 10 times the non-foamed coating liquid volume.

The foamed coating liquid (3) had a viscosity of 25,000 cps as measured by a Brookfield viscometer.

The foamed coating liquid (3) was coated on a surface of the nonwoven fabric by using a Meyer bar coater and dried. The resultant foamed undercoat layer had a dry solid weight of 8 g/m$^2$.

The same coating liquid (2) as in Example 1 was coated on the foamed undercoat layer surface by using a Meyer bar coater and dried to form a non-foamed ink-receiving layer having a dry solid weight of 15 g/m$^2$.

An ink jet recording sheet was obtained.

Example 3

An ink jet recording sheet was produced using the same procedures as in Example 1 with the following exceptions.

A spun-bonded filament nonwoven fabric was prepared by melt-spinning a polyethylene terephthalate resin at a temperature of 280° C., accumulating the melt-spun filaments to form a web, and partially bonding the filaments by heat-pressing the web between a pair of embossing rolls at a temperature of 230° C. The filaments in the resultant nonwoven fabric had a thickness of 2.78 dtex (2.5 denier) and the nonwoven fabric had a basis weight of 30 g/m$^2$.

Separately, a coating liquid (4) for a foamed undercoat layer was prepared by mixing 100 parts by weight of an SBR latex (trademark: Latex 0629, made by Nihon Goseigomu, dry solid content: 46% by weight) with 10 parts by weight of titanium dioxide (trademark: JA-1, made by Teikoku Kako) and 5 parts by weight of a foam stabilizer (trademark: F-1, made by Dainihon Ink) and foaming the mixture by a hand mixer to such an extent that the apparent volume of the foamed coating liquid increased to 6 times the non-foamed coating liquid volume.

The foamed coating liquid (4) had a viscosity of 28,000 cps as measured by a Brookfield viscometer.

The foamed coating liquid (4) was coated on a surface of the nonwoven fabric by using a Meyer bar coater and dried. The resultant foamed undercoat layer had a dry solid weight of 10 g/m$^2$.

Separately, a coating liquid (5) for an ink-receiving layer was prepared by mixing 100 parts by dry weight of fine silica particles (trademark: Fineseal, made by Tokuyama) having an oil absorption value of 280 ml/100 g, a specific surface area of 290 m$^2$/g and a secondary particle size of 4.3 μm, with 20 parts by dry weight of SBR latex (trademark: 0613, made by Nihon Goseigomu).

The coating liquid (5) was coated on the foamed undercoat layer surface by using a Meyer bar coater and dried to form a non-foamed ink-receiving layer having a dry solid weight of 12 g/m$^2$.

An ink jet recording sheet was obtained.

Example 4

An ink jet recording sheet was produced using the same procedures as in Example 1 with the following exceptions.

A spun-bonded filament nonwoven fabric was prepared by melt-spinning a polypropylene resin at a temperature of 230° C., accumulating the melt-spun filaments to form a web, and partially bonding the filaments by heat-pressing the web between a pair of embossing rolls at a temperature of 140° C. The filaments in the resultant nonwoven fabric had a thickness of 2.2 dtex (2.0 denier) and the nonwoven fabric had a basis weight of 60 g/m$^2$.

Separately, a coating liquid (6) for a foamed undercoat layer was prepared by mixing 100 parts by weight of a polyvinyl acetate emulsion (trademark: Boncoat 2830, made by Dainihon Ink, dry solid content: 50% by weight) with 10 parts by weight of a foam stabilizer (trademark: F-1, made by Dainihon Ink) and foaming the mixture by a hand mixer to such an extent that the apparent volume of the foamed coating liquid increased to 8 times the non-foamed coating liquid volume.

The foamed coating liquid (6) had a viscosity of 32,000 cps as measured by a Brookfield viscosity.

The foamed coating liquid (6) was coated on a surface of the nonwoven fabric by using a Meyer bar coater and dried. The resultant foamed undercoat layer had a dry solid weight of 5 g/m$^2$.

The same coating liquid (5) as in Example 3 was coated on the foamed undercoat layer surface by using a Meyer bar coater and dried to form a non-foamed ink-receiving layer having a dry solid weight of 20 g/m$^2$.

An ink jet recording sheet was obtained.

Example 5

An ink jet recording sheet was produced by the same procedures as in Example 1 with the following exceptions.

A coating liquid (7) for a foamed undercoat layer was prepared by mixing 100 parts by weight of a polyacrylic resin emulsion (trademark: Boncoat 3226, made by Dainihon Ink, dry solid content: 45% by weight) with 6 parts by weight of a foam stabilizer (trademark: SN Foam 200, made by San Nopco) and foaming the mixture by a hand mixer to such an extent that the apparent volume of the foamed coating liquid increased to 6 times the non-foamed coating liquid volume.

The foamed coating liquid (7) had a viscosity of 25,000 cps as measured by a Brookfield viscometer.

The foamed coating liquid (7) was coated on a surface of the same nonwoven fabric as in Example 1, using a Meyer bar coater, and dried. The resultant foamed undercoat layer had a dry solid weight of 20 g/m$^2$.

Separately, a coating liquid (8) for an ink-receiving layer was prepared by mixing 100 parts by dry weight of fine silica particles (trademark: Fineseal, made by Tokuyama) having an oil absorption value of 280 ml/100 g, a specific surface area of 290 m$^2$/g and a secondary particle size of 4.3 μm, with 7 parts by dry weight of a modified polyvinyl alcohol (trademark: Gosefimer, made by Nihon Goseikagaku) and 10 parts by dry weight of an SBR latex (trademark: 0613, made by Nihon Goseigomu).

The coating liquid (8) was coated on the foamed undercoat layer surface by using a Meyer bar coater and dried to form a non-foamed ink-receiving layer having a dry solid weight of 5 g/m$^2$.

An ink jet recording sheet was obtained.

Comparative Example 1

An ink jet recording sheet was produced by the same procedures as in Example 1 except that the foamed undercoat layer was omitted and the non-foamed ink-receiving layer had a dry solid weight of 23 g/m$^2$.

Comparative Example 2

An ink jet recording sheet was produced by the same procedures as in Example 2 except that the foamed undercoat layer had a dry weight of 2 g/m$^2$.

Comparative Example 3

An ink jet recording sheet was produced by the same procedures as in Example 5 except that the nonwoven fabric was replaced by a synthetic paper sheet (trademark: Yupo FPG 60, made by Oji Yuka Goseishi, thickness: 60 μm), and the foamed undercoat layer was omitted.

In the above-mentioned examples and comparative examples, the resultant ink jet recording sheets were subjected to the following tests.

(1) Permeability of coating liquid for forming an ink-receiving layer through the substrate sheet.

The permeability of the coating liquid for the ink-receiving layer through a substrate sheet or a laminate of a substrate sheet and an undercoat layer formed on the substrate sheet was observed by the naked eye, and the resistance to the permeation of the coating liquid was evaluated into the following classes.

| Class | Permeability |
|---|---|
| 3 | No coating liquid permeated to the back surface of the substrate sheet. |

-continued

| Class | Permeability |
|---|---|
| 2 | A small amount of the coating liquid permeated to the back surface of the substrate sheet. |
| 1 | A large amount of the coating liquid permeated to the back surface of the substrate sheet. |

(2) Ink absorption

An ink jet recording sheet was ink-printed by an ink jet printer (DESK WRITER, made by Hewlett Packard), and the time, in seconds, necessary to complete the drying of the printed ink was measured. The necessary drying time was classified into the following three classes.

| Class | Ink absorption (Drying time (sec)) |
|---|---|
| 3 | 3 seconds or less |
| 2 | 4 to 10 seconds |
| 1 | 11 seconds or more |

(3) Color brightness

By using an ink jet printer (DESK WRITER-C, made by Hewlett Packard), yellow, magenta and cyan inks were printed. The printed colored images in each color were observed by the naked eye and evaluated into the following classes.

| Class | Color brightness |
|---|---|
| 3 | Bright |
| 2 | Slightly unsatisfactory |
| 1 | Bad |

(4) Dot reproducibility

The ink dots printed by the ink jet printer (DESK WRITER, made by Hewlett Packard) was observed through a microscope, and evaluated into the following classes.

| Class | Form of printed dots |
|---|---|
| 3 | Substantially complete circle |
| 2 | Slightly deformed circle |
| 1 | Clearly deformed circle |

(5) Tear strength

The tear strength of an ink jet recording sheet was determined in accordance with Japanese Industrial Standard (JIS) P 8116.

(6) Water resistance

The ink jet recording sheet was immersed in water at a temperature of 20° C. for one hour, and the separation of the coated layers and the substrate sheet from each other, the wrinkling of the sheet after drying and the breakage of the sheet were observed by naked eye. The water resistance of the recording sheet was evaluated into the following classes.

| Class | Water resistance |
|---|---|
| 3 | Substantially no change occurred. |
| 2 | Slight changes occurred. |
| 1 | Significant changes occurred. |

(7) Smoothness

The Bekk smoothness of an ink jet recording sheet was determined in accordance with Japanese Industrial Standard P 8119.

The test results are shown in Table 1.

TABLE 1

| Example No. | Item: Resistance to permeation of coating liquid | Color brightness | Ink absorption | Dot-reproducibility | Tear strength (g): Longitudinal | Tear strength (g): Transversal | Water resistance | Bekk smoothness (sec.) |
|---|---|---|---|---|---|---|---|---|
| Example | | | | | | | | |
| 1 | 3 | 3 | 3 | 3 | 480 | 500 | 3 | 5 |
| 2 | 3 | 3 | 3 | 3 | 1250 | 540 | 3 | 7 |
| 3 | 3 | 3 | 3 | 3 | 160 | 380 | 3 | 5 |
| 4 | 3 | 3 | 3 | 3 | 600 | 505 | 3 | 8 |
| 5 | 3 | 3 | 3 | 3 | 480 | 500 | 3 | 2 |
| Comparative Example | | | | | | | | |
| 1 | 1 | 3 | 3 | 3 | 480 | 500 | 3 | 2 |
| 2 | 1 | 3 | 3 | 3 | 1250 | 540 | 3 | 3 |
| 3 | 3 | 3 | 2 | 2 | 18 | 7 | 3 | 280 |

A spun-bonded filament nonwoven fabric was prepared by accumulating a plurality of continuous polyethylene terephthalate filaments to form a web, and partially bonding the filaments by heat-pressing the web between a pair of embossing rolls at a temperature of 230° C. The filaments in the resultant nonwoven fabric had a thickness of 3.0 dtex (2.7 denier) and the nonwoven fabric had a thickness of 250 μm.

Separately, a coating liquid (10) for a foamed undercoat layer was prepared by mixing 100 parts by weight of a polyurethane emulsion (trademark: Polyurethane HW 940, made by Dainihon Ink, dry solid content: 50% by weight) with 10 parts by weight of a foam stabilizer (trademark: F-1, made by Dainihon Ink) and foaming the mixture using a hand mixer to such an extent that the apparent volume of the foamed coating liquid increased to 8 times the non-foamed coating liquid volume.

The foamed coating liquid (10) had a viscosity of 33,000 cps as measured by a Brookfield viscometer.

The foamed coating liquid (10) was coated on a surface of the nonwoven fabric by using a Meyer bar coater and dried. The resultant foamed undercoat layer had a dry solid weight of 10 g/m$^2$.

Separately, a coating liquid (11) for an ink-receiving layer was prepared by mixing 100 parts by dry weight of fine silica particles (trademark: Fineseal, made by Tokuyama) having an oil absorption value of 280 ml/100 g, a specific surface area of 290 m$^2$/g and a secondary particle size of 4.3 μm, with 30 parts by dry weight of polyvinyl alcohol (trademark: PVA 117, made by Kuraray).

The coating liquid (11) was coated on the foamed undercoat layer surface by using a Meyer bar coater and dried to form a non-foamed ink-receiving layer having a dry solid weight of 8 g/m$^2$.

An ink jet recording sheet was obtained.

Example 7

A spun-bonded filament nonwoven fabric was prepared by accumulating a plurality of continuous polypropylene filaments to form a web, and partially bonding the filaments by heat-pressing the web between a pair of embossing rolls at a temperature of 140° C. The filaments in the resultant nonwoven fabric had a thickness of 2.2 dtex (2.0 denier) and the nonwoven fabric had a thickness of 120 μm.

Separately, a coating liquid (12) for a foamed undercoat layer was prepared by mixing 100 parts by weight of a polyvinyl acetate emulsion (trademark: Boncoat 2830, made by Dainihon Ink, dry solid content: 50% by weight) with 7 parts by weight of a foam stabilizer (trademark: SN Foam 200, made by San Nopco) and foaming the mixture using a hand mixer to such an extent that the apparent volume of the foamed coating liquid increased to 6 times the non-foamed coating liquid volume.

The foamed coating liquid had a viscosity of 27,000 cps as measured by a Brookfield viscometer.

The foamed coating liquid (12) was coated on a surface of the nonwoven fabric by using a Meyer bar coater and dried. The resultant foamed undercoat layer had a dry solid weight of 12 g/m$^2$.

The same coating liquid (11) as in Example 6 was coated on the foamed undercoated layer surface by using a Meyer bar coater and dried to form a non-foamed ink-receiving layer having a dry solid weight of 6 g/m$^2$.

An ink jet recording sheet was obtained.

Example 8

A staple fiber nonwoven fabric was prepared by accumulating a polypropylene staple fibers to form a web, and partially bonding the staple fibers by heat-pressing the web between a pair of embossing rolls at a temperature of 140° C. The staple fibers in the resultant nonwoven fabric had a thickness of 2.2 dtex (2.0 denier) and a length of 50 mm and the nonwoven fabric had a thickness of 150 μm.

Separately, a coating liquid (13) for a foamed undercoat layer was prepared by mixing 100 parts by weight of an SBR latex (trademark: 0629, made by Nihon Goseigomu, dry solid content: 46% by weight) with 15 parts by weight of titanium dioxide (trademark: JA-1, made by Teikoku Kako) and 15 parts by weight of a foam stabilizer (trademark: F-1, made by Dainihon Ink) and foaming the mixture using a hand mixer to such an extent that the apparent volume of the foamed coating liquid increased to 5 times the non-foamed coating liquid volume.

The foamed coating liquid had a viscosity of 20,000 cps as measured by a Brookfield viscometer.

The foamed coating liquid (13) was coated on a surface of the nonwoven fabric by using a Meyer bar coater and dried. The resultant foamed undercoat layer had a dry solid weight of 8 g/m$^2$.

Separately, a coating liquid (14) for an ink-receiving layer was prepared by mixing 100 parts by dry weight of fine silica particles (trademark: Tokuseal, made by Tokuyama) having an oil absorption value of 260 ml/100 g, a specific surface area of 200 m$^2$/g and a secondary particle size of 8.0 μm, with 20 parts by dry weight of an oxidized starch (trademark: Ace A, made by Oji Corn Starch), and 15 parts by dry weight of a polyacrylic resin emulsion (trademark: Boncoat 3226, made by Dainihon Ink).

The coating liquid (14) was coated on the foamed undercoat layer surface by using a Meyer bar coater and dried to form a non-foamed ink-receiving layer having a dry solid weight of 11 g/m$^2$.

An ink jet recording sheet was obtained.

Example 9

A staple fiber-carded nonwoven fabric was prepared by accumulating core-in-sheath type composite staple fibers each consisting of a polypropylene core and a polyethylene sheath to form a web, and partially bonding the filaments by heat-pressing the web between a pair of smooth rolls at a temperature of 140° C. by melting the polyethylene sheaths. The staple fibers in the resultant nonwoven fabric had a thickness of 2.0 dtex (1.8 denier) and the nonwoven fabric had a thickness of 300 μm.

The same foamed coating liquid (10) as in Example 6 was coated on a surface of the nonwoven fabric by using a Meyer bar coater and dried. The resultant foamed undercoat layer had a dry solid weight of 20 g/m$^2$.

The same coating liquid (11) as in Example 6 was coated on the foamed undercoat layer surface by using a Meyer bar coater and dried to form a non-foamed ink-receiving layer having a dry solid weight of 18 g/m$^2$.

An ink jet recording sheet was obtained.

Example 10

A staple fiber nonwoven fabric was prepared, by a wet laid nonwoven fabric-forming method, from a blend of 100 parts by weight of polypropylene staple fibers and 10 parts by weight of polyvinyl alcohol binder staple fibers.

The resultant nonwoven fabric had a thickness of 250 μm.

The same foamed coating liquid (10) as in Example 6 was coated on a surface of the nonwoven fabric by using a Meyer bar coater and dried. The resultant foamed undercoat layer had a dry solid weight of 15 g/m$^2$.

Then, the same coating liquid (14) as in Example 8 was coated on the foamed undercoat layer surface by using a Meyer bar coater and dried to form a non-foamed ink-receiving layer having a dry solid weight of 15 g/m$^2$.

An ink jet recording sheet was obtained.

Example 11

A viscose rayon plain weave fabric having a thickness of 200 μm was employed as a substrate sheet.

The same foamed coating liquid (12) as in Example 7 was coated on a surface of the woven fabric by using a Meyer bar coater to form a foamed undercoat layer having a dry weight of 10 g/m$^2$.

Then, the same coating liquid (14) as in Example 8 was coated on the foamed undercoat layer surface by using a Meyer bar coater to form a non-foamed ink-receiving layer having a dry weight of 5 g/m$^2$.

An ink jet recording sheet was obtained.

Comparative Example 4

An ink jet recording sheet was produced by the same procedures as in Example 6 with the following exceptions.

The undercoat was omitted.

The ink-receiving layer had a dry weight of 25 g/m$^2$.

Comparative Example 5

An ink jet recording sheet was produced by the same procedures as in Example 7 except that the nonwoven fabric was replaced by a synthetic paper sheet (trademark: Yupo FPG 60, made by Oji Yuka Goseishi, thickness: 60 μm) and the foamed undercoat layer was omitted.

Comparative Example 6

The same ink jet recording sheet as in Example 6 was surface-smoothed with a laboratory super calender having a metal roll and a cotton roll. The sheet was calendered by passing is between the metal roll with which the ink receiving layer surface of the sheet was brought into contact, and the cotton roll, under a linear pressure of 20 kg/cm at a temperature of 40° C. A surface-smoothed ink jet recording sheet was obtained.

Comparative Example 7

The same procedures as in Comparative Example 6 were carried out except that the calendering procedure was effected under a linear pressure of 70 kg/cm and a temperature of 30° C. A surface-smoothed ink jet recording sheet was obtained.

The same tests as in Example 1 were applied to the ink jet recording sheets of Examples 6 to 11 and Comparative Examples 4 to 7.

The test results are shown in Table 2.

TABLE 2

| | Item | | | | | | | |
|---|---|---|---|---|---|---|---|---|
| | Resistance to permeation | Color | Ink | Dot-repro- | Tear strength (g) | | Water | Bekk smooth- |
| Example No. | of coating liquid | bright-ness | absorp-tion | duci-bility | Longi-tudinal | Trans-versal | resist-ance | ness (sec.) |
| Example | | | | | | | | |
| 6 | 3 | 3 | 3 | 3 | 700 | 520 | 3 | 3 |
| 7 | 3 | 3 | 3 | 3 | 150 | 370 | 3 | 3 |
| 8 | 3 | 3 | 3 | 3 | 160 | 240 | 3 | 5 |
| 9 | 3 | 3 | 3 | 3 | 350 | 280 | 3 | 8 |
| 10 | 3 | 3 | 3 | 3 | 300 | 300 | 3 | 6 |
| 11 | 3 | 3 | 3 | 3 | 1400 | 1400 | 3 | 2 |
| Comparative Example | | | | | | | | |
| 4 | 1 | 3 | 3 | 3 | 700 | 520 | 3 | 1 |
| 5 | 3 | 3 | 2 | 2 | 18 | 7 | 3 | 290 |
| 6 | 3 | 3 | 2 | 2 | 650 | 500 | 3 | 14 |
| 7 | 3 | 3 | 1 | 2 | 600 | 480 | 3 | 30 |

We claim:

1. An ink jet recording sheet comprising:

a substrate sheet;

a foamed undercoat layer formed on the substrate sheet and comprising a polymeric binder; and an ink-receiving layer formed on the foamed undercoat layer and comprising a mixture of 50 to 90% by weight of amorphous silica particles having an oil absorption value of 100 to 400 ml/100 g with 10 to 50% by weight of a polymeric binder, the ink-receiving layer being provided with a surface thereof having a Bekk smoothness of 10 seconds or less, determined in accordance with Japanese Industrial Standard P 8119.

2. The ink jet recording sheet as claimed in claim 1, wherein the substrate sheet comprises a member selected from the group consisting of nonwoven fabrics and woven fabrics.

3. The ink jet recording sheet as claimed in claim 2, wherein the nonwoven fabrics are selected from the group consisting of spun-bonded filament nonwoven fabrics, staple fiber-carded nonwoven fabrics, dry laid nonwoven fabrics and wet laid nonwoven fabrics.

4. The ink jet recording sheet as claimed in claim 3, wherein the filaments for the spun-bonded filament nonwoven fabrics comprise a member selected from the group consisting of polyolefin resins, polyester resins, polyacrylate resins and polyamide resins.

5. The ink jet recording sheet as claimed in claim 1, wherein the substrate sheet has a basis weight of 20 to 150 $g/m^2$.

6. The ink jet recording sheet as claimed in claim 1, wherein the polymeric binder of the foamed undercoat layer comprises at least one member selected from the group consisting of homopolymers and copolymers of acrylic acid esters, polymethacrylic acid esters, ethylene-vinyl acetate copolymers, styrene-butadiene copolymers, acrylonitrile-butadiene copolymers, methyl methacrylate-butadiene copolymers, polyester resins, and polyurethane resins.

7. The ink jet recording sheet as claimed in claim 1, wherein the undercoat layer further comprises a pigment comprising at least one member selected from the group consisting of calcium carbonate, magnesium carbonate, magnesium hydroxide, aluminum hydroxide, zinc hydroxide, zinc oxide, titanium dioxide, aluminum oxide, silicon dioxide, amorphous silica, barium sulfate, kaolinite, talc, styrene polymer and copolymer resins and acrylic acid ester polymer and copolymer resins.

8. The ink jet recording sheet as claimed in claim 1, wherein the undercoat layer is one formed by foaming a coating liquid containing a polymeric binder and coating the foamed coating liquid onto a surface of the substrate sheet.

9. The ink jet recording sheet as claimed in claim 8, wherein the coating liquid for the undercoat layer further comprises a foam stabilizer.

10. The ink jet recording sheet as claimed in claim 8, wherein the foamed coating liquid has a viscosity of 4000 to 300,000 cps, as measured by a Brookfield viscometer.

11. The ink jet recording sheet as claimed in claim 1, wherein the undercoat layer has a dry solid weight of 3 to 50 $g/m^2$.

12. The ink jet recording sheet as claimed in claim 1, wherein the polymeric binder of the ink-receiving layer comprises at least one member selected from the group consisting of polyvinyl alcohol resins, silanol-modified polyvinyl alcohols, esterified polyvinyl alcohols, etherified polyvinyl alcohols and acetalized polyvinyl alcohols, proteins, starch, esterified starchs, etherified starchs, cross-linked starchs, conjugated diene copolymers, acrylic acid ester polymer and copolymers, methacrylic acid ester polymer and copolymers, vinyl compound polymers and copolymers, carboxyl or cationic group-modified compounds of the above-mentioned polymers and copolymers, melamine-formaldehyde resins, urea-formaldehyde resins, polyacrylamide resins, polyurethane resins, unsaturated polyester resins, polybutyral resins, and alkyd resins.

13. The ink jet recording sheet as claimed in claim 1, wherein the amorphous silica particles have a specific surface area of 100 to 450 $m^2/g$.

14. The ink jet recording sheet as claimed in claim 1, wherein the amorphous silica particles have a secondary particle size of 1 to 10 μm.

15. The ink jet recording sheet as claimed in claim 1, wherein the ink-receiving layer has a dry solid weight of 3 to 30 $g/m^2$.

16. The ink jet recording sheet as claimed in claim 1, wherein the undercoat layer is one formed by blowing air into an aqueous coating liquid containing a polymeric binder during mechanical agitation of the aqueous coating liquid to foam it; and coating the resultant foamed aqueous coating liquid onto the substrate sheet.

17. The ink jet recording sheet as claimed in claim 16, wherein the blowing of air causes the apparent volume of the aqueous coating liquid to increase to 2.0 to 20.0 times.

18. The ink jet recording sheet as claimed in claim 16, wherein the foamed aqueous coating liquid has a viscosity of 3,000 to 200,000 cps as determined by a Brookfield viscometer.

19. The ink jet recording sheet as claimed in claim 1, wherein the polymeric binder of the ink-receiving layer comprises a member selected from cationic group-containing polymeric compounds and carboxylic group-containing polymeric compounds.

20. The ink jet recording sheet as claimed in claim 1, wherein the substrate sheet is selected from nonwoven fabrics in which a plurality of continuous filaments are accumulated and partially fuse-bonded to each other, nonwoven fabrics in which a plurality of staple fibers are opened and accumulated by a carding machine and the opened staple fibers are thermally bonded to each other, and nonwoven fabrics in which a plurality of fibers are formed into a sheet and entangled with each other by a high pressure hydro-entanglement method.

21. A method of recording ink dotted images on the ink jet recording sheet as claimed in claim 1 by jetting imagewise aqueous inks onto the recording sheet.

* * * * *